United States Patent [19]

Phillips

[11] 4,006,501

[45] Feb. 8, 1977

[54] WATER BED MATTRESS

[76] Inventor: Raymond M. Phillips, 305 Poquito Lane, Topanga, Calif. 90290

[22] Filed: May 27, 1975

[21] Appl. No.: 581,262

[52] U.S. Cl. ..... 5/371

[51] Int. Cl.[2] ..... A47C 27/08

[58] Field of Search ..... 5/348 R, 348 WB, 365, 5/370, 371; 128/376

[56] References Cited

UNITED STATES PATENTS

| | | | |
|---|---|---|---|
| 3,778,852 | 12/1973 | Penn et al. | 5/348 WB |
| 3,787,907 | 1/1974 | Pennington et al. | 5/348 WB |
| 3,802,004 | 4/1974 | Whitney | 5/348 WB |
| 3,840,921 | 10/1974 | Labianco | 5/348 WB |
| 3,918,110 | 11/1975 | Cantillo et al. | 5/348 WB |

*Primary Examiner*—Paul R. Gilliam
*Assistant Examiner*—Andrew M. Calvert
*Attorney, Agent, or Firm*—Robert J. Schaap

[57] ABSTRACT

A water bed mattress comprised of upper and lower flexible sheets which are provided with peripherally extending downwardly and upwardly struck flaps, respectively, at their outer peripheral ends. These flaps are sealed to each other in order to form a completely enclosed mattress. A tapered, angularly struck inner peripheral wall extends effectively between the upper and lower walls of the water bed mattress in such manner that the upper end of the inner peripheral wall extends to the outer peripheral margin of the upper wall and the lower end of the inner peripheral wall terminates inwardly of the outer peripheral margin of the lower wall. In this way, the inner peripheral wall operates in conjunction with the upper wall in order to form an inner water chamber which is essentially coextensive with the entire upper surface of the upper wall. An air chamber is formed by the other side of the inner peripheral wall, the outer wall and the lower wall. Thus, the air chamber increases in size with the increased depth in the outer peripheral wall. The inner peripheral wall and the flaps which form the outer peripheral wall may be either lap sealed or otherwise butt sealed to each other in accordance with the present invention. The present invention also provides a unique method of making the water bed mattress of the present invention.

20 Claims, 17 Drawing Figures

WATER BED MATTRESS

BACKGROUND OF THE INVENTION

This invention relates in general to certain new and useful improvements in water bed mattresses and the method of making the same and, more particularly, to water bed mattresses which include a water chamber which is surrounded by a lower air chamber but which permits the water chamber to be substantially contiguous with a portion of the upper surface of the water bed.

In recent years, water beds have become widely commerically acceptable and have found substantially increased use. It has now been fairly well recognized that water beds, that is those forms of beds which employ a water filled mattress, have not only enjoyment value, but therapeutic value as well. In general, it has been found that many people find that it is not only more enjoyable, but is more restful to sleep on a water bed mattress than other forms of conventional mattresses filled with solid, but nevertheless, resilient, material.

The present commercially available water bed mattresses generally comprise a rectangular shell formed primarily of some form of a fairly flexible plastic material and which is filled with water. This form of water bed mattress is thereupon supported in, and by virtue of its construction is required to be supported in, a rigid frame.

In recent years, there have been various other forms of water bed mattresses which include an air frame peripherally surrounding a water bladder, as for example in the Penn et al. U.S. Pat. No. 3,778,852, and the Pennington et al. U.S. Pat. No. 3,787,907. This latter form of water bed mattress, which includes a surrounding air frame, is typically referred to as an air frame water bed mattress. These air frame mattresses differ substantially from the pure water bed mattress, without the air frame, in that those mattresses including the air frame do not require the employment of a rigid structural frame.

The presently available water bed mattresses which do not include the air frame suffer from a large number of deficiencies such as the fact that these mattresses do not obviate the problem of wave action created in the water in the water chamber due to a sudden localized force. Consequently, when a person lies upon a water bed mattress without the surrounding air frame, the water shifts substantially thereby creating substantial wave action and also the attendant displacement of the surface contour of the mattress.

The other forms of water bed mattresses including the air frame surrounding the water bladder, as exemplified by the Penn et al. Patent and the Pennington et al. Patent mentioned above, also suffer from a number of substantial disadvantages. It has again been well established that those water beds which include the surrounding air frame and which avoid the necessity of a rigid frame do not provide the required degree of comfort. It has been theorized that these water bed mattresses eliminate some of the wave action which is created by a sudden localized force. Nevertheless, it is also well established that the air bladder is relatively incompressible with respect to the water bladder. Consequently, the water bed mattresses which include the surrounding air frame do not provide constant and adequate support. The same generally holds true of those water bed mattresses which do not employ the air frame surrounding the water bladder. One of the primary problems of each of these conventional water beds is that they do not provide equal water flotation with respect to the entire upper surface of the water bed mattress.

Another important disadvantage with respect to the water bed mattresses of each of the aforementioned types is that they are not constantly sized with respect to a supporting structure or, otherwise, a supporting frame. Consequently, difficulty often arises in fitting the water bed mattress, when filled with water, or otherwise with water in the water bladder and air in the air bladder, to the supporting frame or a supporting structure. Even more importantly, these water bed mattresses which are presently commercially available to not provide any adequate safety feature in the event of punctures in the mattress itself which could result in immediate and substantial discharge of water with resultant damage.

The present invention obviates these and other problems in the provision of a water bed mattress which includes a pair of upper and lower sheets having peripherally extending, perpendicularly struck side wall flaps. These side wall flaps are secured to each other in order to form an outer peripheral end wall, thereby defining rectangularly shaped water bed mattress. An inner peripheral wall which is tapered extends between the upper and lower walls. This inner peripheral wall extends substantially toward the outer peripheral margin of the upper wall and is inwardly spaced from the outer peripheral margin of the lower wall and is dealed thereto. In this way, a water chamber is established between the wall, the bottom wall and the inner peripheral wall. Moreover, an air chamber is established by the outer wall, the lower wall and the inner peripheral wall. In accordance with this construction, the water chamber is substantially contiguous with the upper wall so that a person lying on the water bed mattress is completely supported by the water chamber with constant flotation. Nevertheless, the air chamber, which is essentially more rigid, surrounds the outer edge of the entire water bed mattress, although the party lying on the water bed mattress does not actually contact the air bladder portion.

It is therefore the primary object of the present invention to provide a water bed mattress which includes a water chamber having a surface substantially across the entire upper surface of said mattress and which is capable of supporting an individual, and an air chamber surrounding at least a lower portion of the water chamber.

It is another object of the present invention to provide a water bed mattress of the type stated which is relatively light in weight, when filled with water in the water chamber, compared to commercially available forms of water bed mattresses.

It is a further object of the present invention to provide a water bed mattress of the type stated which provides constant body support on the upper surface thereof.

It is an additional object of the present invention to provide a water bed mattress of the type stated which is capable of reducing wave action in the water chamber of the mattress created by the impingement of localized forces.

It is also an object of the present invention to provide a water bed mattress of the type stated which is durable in its construction and provides a safety feature substantially greater than any conventional available form of water bed mattress.

It is another salient object of the present invention to provide a method of making the water bed mattress of the type stated which is highly efficient in its operation and requires a minimal amount of manual labor.

With the above and other objects in view, my invention resides in the novel features of form, construction, arrangement and combination of parts presently described and pointed out in the claims.

BRIEF DESCRIPTION OF THE DRAWINGS

Figure 1:
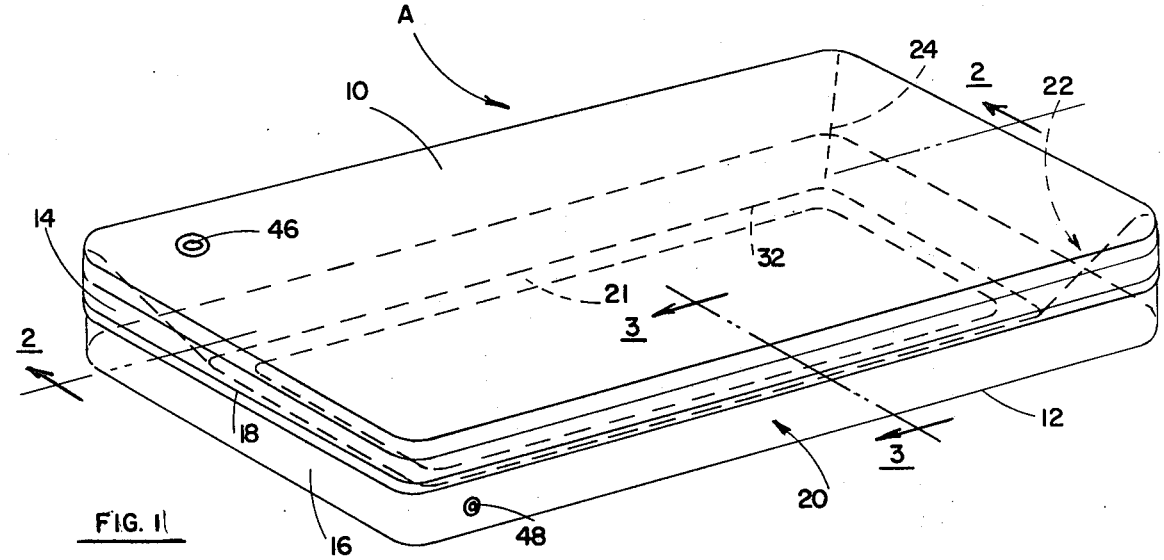
Figure 2:
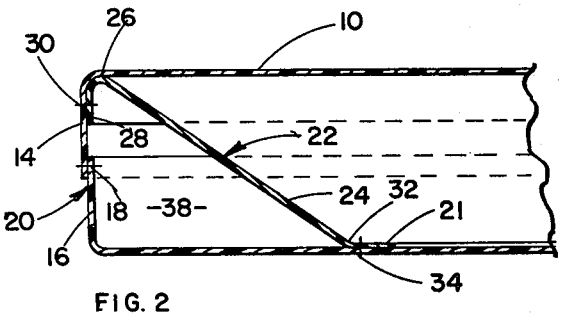
Figure 3:
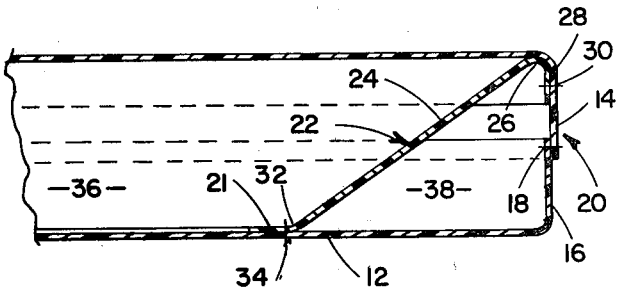
Figure 3:
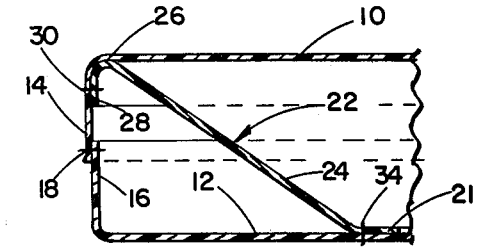
Figure 5:
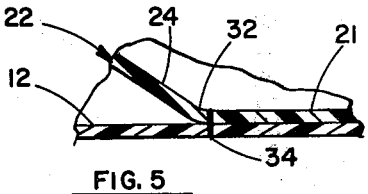
Figure 4:
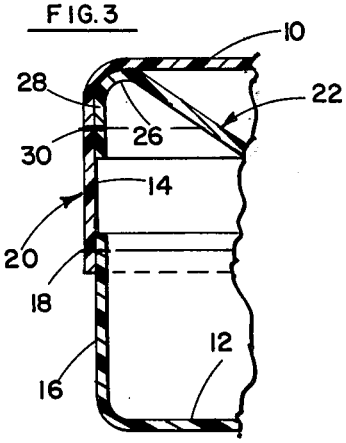
Figure 6:
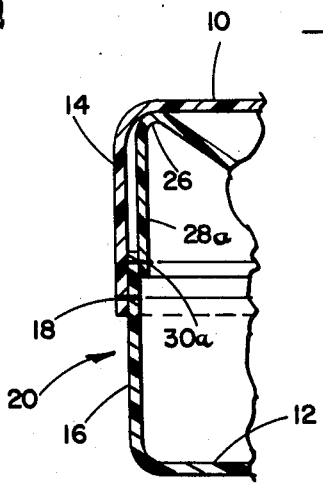
Figure 7:
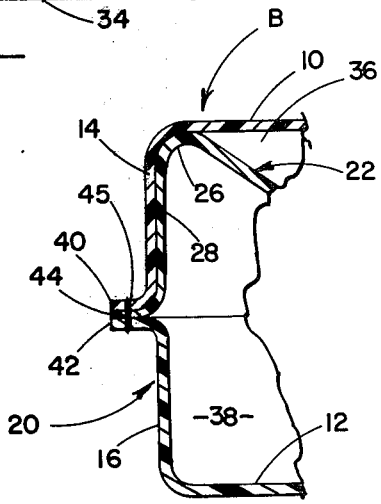
Figure 8:
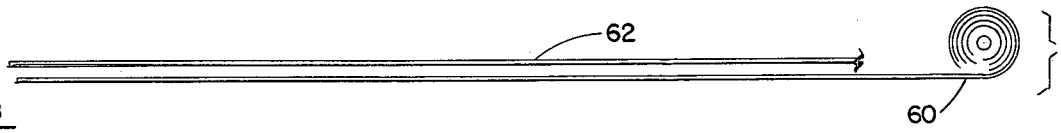
Figure 9:
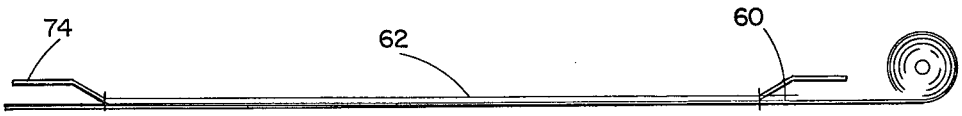
Figure 10:
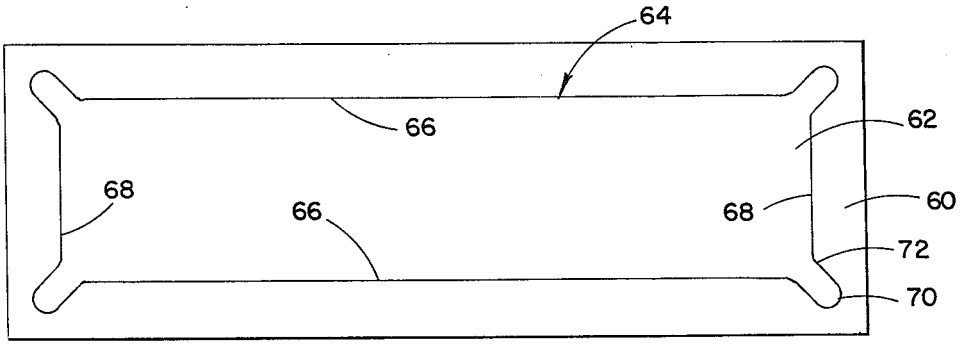
Figure 11:
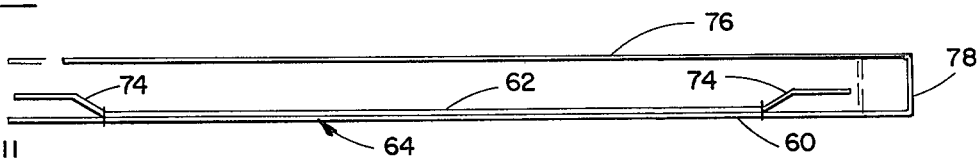
Figure 12:
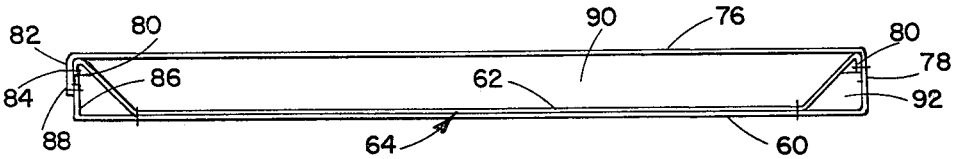
Figure 13:
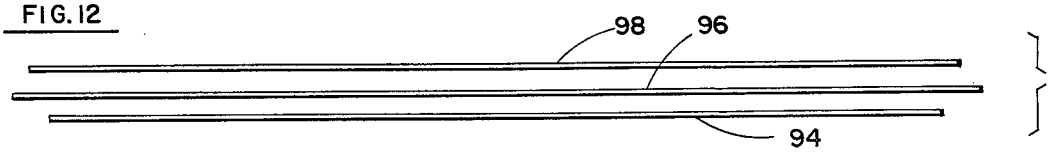
Figure 14:
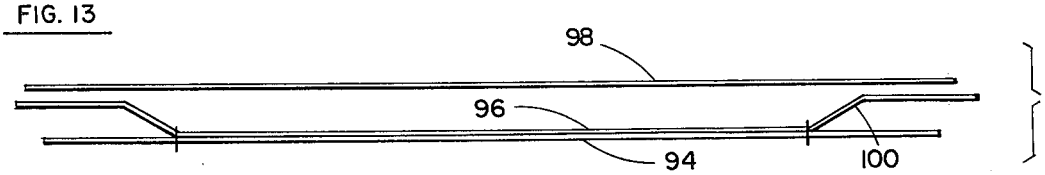
Figure 15:
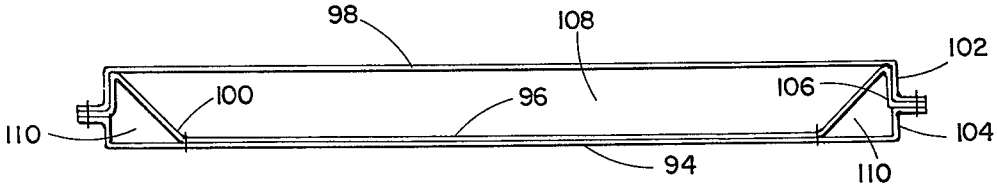

Having thus described the invention in general terms, reference will now be made to the accompanying drawings in which:

FIG. 1 is a perspective view of a water bed mattress, partially shown in phantom lines, constructed in accordance with and embodying the present invention;

FIG. 2 is a fragmentary vertical sectional view taken along line 2—2 of FIG. 1;

FIG. 3 is a fragmentary vertical sectional view taken along line 3—3 of FIG. 1, and showing a portion of the water bed mattress in a different plane with respect to FIG. 2;

FIG. 4 is a fragmentary vertical sectional view showing the seal between an inner wall and the flanges on the upper and lower walls forming part of the water bed mattress of FIG. 1;

FIG. 5 is a fragmentary vertical sectional view showing the attachment of the inner wall to the lower wall forming part of the water bed mattress of FIG. 1;

FIG. 6 is a fragmentary vertical sectional view, similar to FIG. 4, and showing a modified form of construction of the water bed mattress of FIG. 1;

FIG. 7 is a fragmentary vertical sectional view, similar to FIG. 4, and showing an additional modified form of construction of the water bed mattress of FIG. 1;

FIG. 8 is a schematic side elevational view showing a first step in the manufacture of a water bed mattress of the type illustrated in FIG. 1 of the drawings;

FIG. 9 is a vertical sectional view showing a second step in the manufacture of the water bed mattress of FIG. 1 and specifically illustrating the attachment of an inner sheet to the lower sheet forming part of the water bed mattress;

FIG. 10 is a top plan view showing the arrangement of the sheets illustrated in FIG. 9 of the drawings;

FIG. 11 is a vertical sectional view, similar to FIG. 9, and showing a third step in the manufacture of the water bed mattress of FIG. 1;

FIG. 12 is a vertical sectional view, similar to FIG. 11, and showing the completion steps in the manufacture of the water bed mattress of FIG. 1;

FIG. 13 is a vertical sectional view, similar to FIG. 8, and showing the various layers used in the manufacture of the modified form of water bed mattress which is more fully illustrated in FIG. 7 of the drawings;

FIG. 14 is a vertical sectional view, similar to FIG. 13, and showing a second step in the manufacture of the water bed mattress to produce that water bed mattress structure more fully illustrated in FIG. 7; and FIG. 15 is a vertical sectional view, similar to FIG. 14, and showing the completion steps in order to produce the water bed mattress illustrated in FIG. 7 of the drawings.

Figure 17:
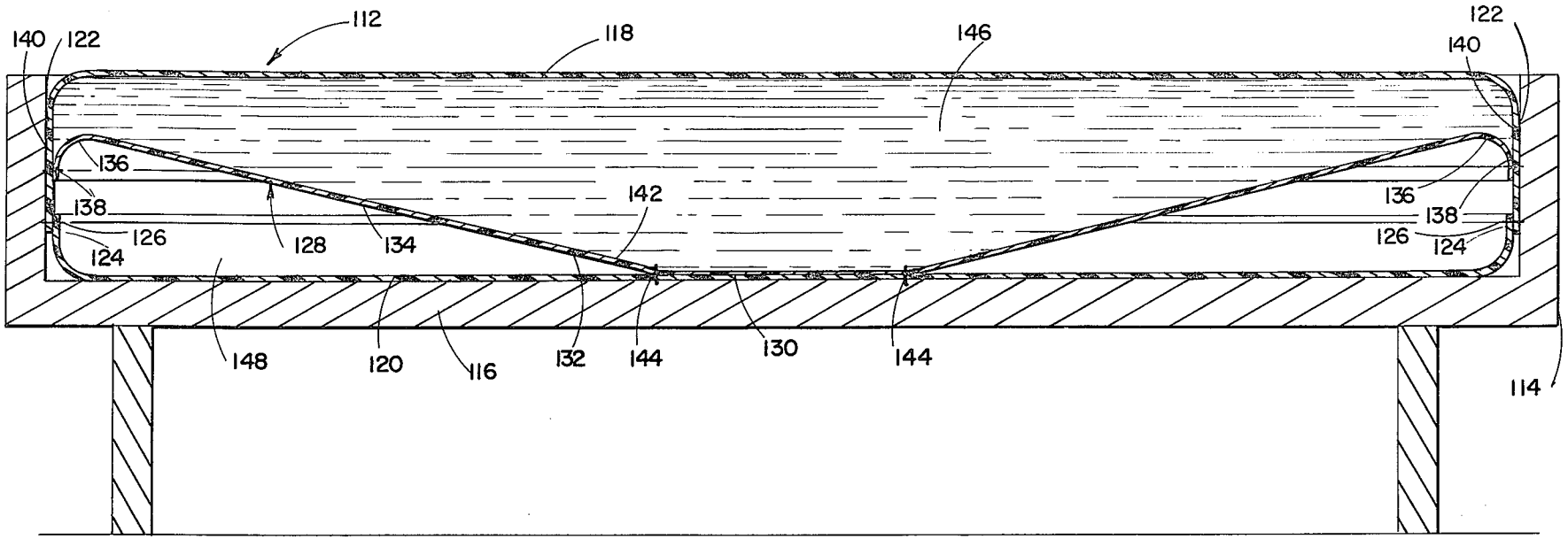
Figure 16:
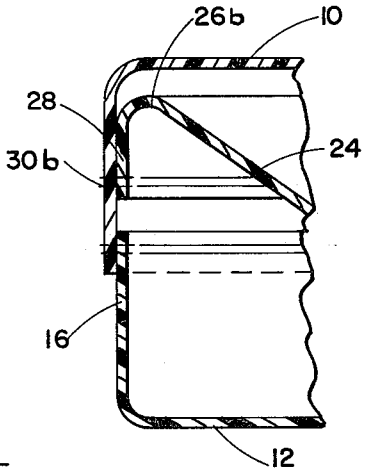

FIG. 16 is a further fragmentary vertical sectional view, similar to FIG. 5, and showing still a further modified form of water bed mattress constructed in accordance with and embodying the present invention; and FIG. 17 is a vertical sectional view, taken along a transverse plane, and showing a preferred form of water bed mattress constructed in accordance with and embodying the present invention.

DETAILED DESCRIPTION

Referring now in more detail and by reference characters to the drawings which illustrate preferred embodiments of the present invention, A designates a water bed mattress comprising an upper flexible plastic sheet 10 and a lower flexible plastic sheet 12, and both of which are substantially rectangular in their construction, but with rounded corner margins.

The upper and lower sheets 10 and 12 are both substantially of the same overall size and are marginally registered with each other, and the upper sheet includes an integrally formed downwardly struck peripherally extending end flap 14. In like manner, the lower wall 12 includes an integrally formed upwardly struck peripherally extending flap 16 which is lap-sealed to the end flap 14 at a seal 18 thereby forming a peripheral outer end wall 20. In this case, it can be observed that the flap 14 which is integral with the upper wall 10 is located exteriorly of the flap 16 in order to form the lap-seal 18. However, it should also be understood that the flap 16 could be located exteriorly of the flap 14 in order to form the lap-seal 18.

The water bed mattress of the present invention also includes a flexible plastic intermediate sheet 21 which is disposed on the interiorly presented surface of the lower sheet 12 and which is integrally provided with a somewhat tapered peripherally extending inner side wall 22 which is more fully illustrated in FIGS. 1–4 of the drawings. This inner peripheral wall 22 includes a diagonally inwardly and downwardly extending relatively straight wall section 24 merging into the intermediate sheet 21 and which wall section 24 is formed at its upper end with an arcuately shaped section 26. This arcuately shaped section 26, in turn, integrally merges into a downwardly extending flange 28 which is essentially located in juxtaposition to the downwardly struck flap 14, in the manner as illustrated in FIGS. 2–4 of the drawings. The downwardly struck flap 28 is lap-sealed to the interior surface of the flap 14 by means of a lap-seal 30, as more fully illustrated in FIGS. 3 and 4 of the drawings.

The peripheral margin 32 of the intermediate sheet 21, that is the location where the sheet 21 merges into the side wall 22, is lap-sealed to the lower sheet 12 by means of a lap-seal 34, in the manner as illustrated in FIG. 5 of the drawings. As an alternate construction, the sheet 21 could be eliminated and the lower and inner peripheral end of the periperhal inner side wall 22 could be integrally provided with an end flange which is lap-sealed to the lower sheet 12.

By reference to FIGS. 1 through 4 of the drawings, it can be observed that the arcuately shaped section 26 of the inner peripheral wall 22 is located substantially near, if not at the very end, of the peripheral margin of the upper wall 10, inasmuch as the curved section 26 is located at the corner margin extending between the upper wall 10 and the downwardly struck flap 14. Moreover, and by reference to FIGS. 2 and 3, it can be observed that the straight section 24 of the wall 22 terminates at the margin 32 substantially inwardly of the outer peripheral end margins of the lower wall 12.

In accordance with the above-outlined construction, it can be observed that the upper sheet 10 and the inner peripheral wall 22, along with the intermediate sheet 21 on the lower sheet 12, defines a water chamber 36. Moreover, it can be observed that the other side of the inner peripheral wall 22, along with the bottom wall 12 and the side wall 20, forms an outer air chamber 38. By further reference to FIGS. 2 and 3 of the drawings, it can be observed that the water chamber is substantially contiguous with the entire upper surface of the upper wall 10 in such manner that the entire upper surface of the water bed mattress A is defined only by the water chamber. Nevertheless, it can be observed that an air chamber 38 extends peripherally around the entire outer wall of the water bed mattress A and, in this way, the air chamber increases in size with the increased depth in the outer peripheral wall 22.

FIG. 6 illustrates a modified form of water bed mattress constructed in accordance with and embodying the present invention and differs only from the water bed mattress previously described in that the downwardly struck flange 28 is a somewhat longer flange designated as 28*a* and which is heat-sealed to the upwardly struck lap 16 by means of a heat seal 30*a*. Otherwise, the construction of the water bed mattress, as illustrated in FIG. 6, is substantially identical to the construction of the water bed mattress illustrated in FIGS. 1–5 of the drawings. The water bed mattress as illustrated in FIG. 6 of the drawings does not otherwise differ from the water bed mattress illustrated in FIGS. 1–5 of the drawings except that the flange 28*a* is longer and is secured to the lower flap 16, which is sometimes desirable in certain constructions of the water bed mattress A.

FIG. 7 of the drawings illustrates a further modified form of water bed mattress B which similarly includes the top wall 10 having its downwardly struck flap 14 and the bottom wall 12, along with its upwardly struck flap 16, to thereby form the end wall 20. In addition, the water bed mattress B similarly includes the inner peripheral wall 22, as illustrated in FIG. 7, and which includes the downwardly struck flange 28, which is integral with the straight portion of the wall 22 through the curved section 26. In this case, the flap 14 and the flap 16 are provided with integrally formed laterally outwardly struck terminal flanges 40 and 42, respectively. In like manner, the downwardly struck 28, which is integral with the inner peripheral wall 22, is similarly provided with a laterally struck continuously peripherally outwardly struck flange 44.

By further reference to FIG. 7, it can be observed that the flanges 40, 42 and 44 are each butt-sealed to each other. Nevertheless, it can be observed that the water bed mattress B is provided with the inner water chamber 36 and the lower air chamber 38. While not illustrated in FIG. 7 of the drawings, it should also be understood that the lower end of the inner peripheral wall 22 is similarly integral with the intermediate sheet 21 which is heat-sealed and, preferably, lap-sealed to the lower wall 12 by means of the heat seal 34.

In this respect, it should be understood that lap seals are generally preferred in the construction of the water bed mattresses of the present invention inasmuch as they provide a greater degree of safety with respect to the sealing of the various plastic components. Nevertheless, it has also been found that butt seals are also effective in producing a water bed mattress in accordance with the present invention.

The water bed mattresses A and B are both provided with a water inlet 46 communicating with the water chamber 36, as well as an air inlet 48 communicating with the air chamber 38. This water inlet 46 and the air inlet 48 may be in the form of fittings which are integral with the respective plastic sheets, as shown and illustrated in FIG. 1 of the drawings, and provided with removable, but nevertheless fluid-tight, caps in order to provide entry and exit of either water or air from the respective chambers 36 and 38.

Several unique features are inherently created by the water bed mattresses of the present invention which include relatively light weight, compared to other conventional prior art water bed mattresses, due to the large air chamber which surrounds the lower portion of the water chamber. In addition, the water bed mattresses of the present invention provide a more substantially constant support due to the fact that the air bladder is effectively located under the water bladder and which thereby produces a constant flotation on the top of the water bed mattress. In addition, the air chamber 38 serves to effect as a baffle which thereby inhibits water motion and, hence, the wave action which would otherwise be created by a sudden impact or otherwise a localized force impingement on the surface of the water bed mattress. In this way, it can be observed that there is an increased ease of exit and entry with respect to the water bed mattress.

In the conventional complete water bladder mattress, it was virtually impossible to sit on the edge of the water bed inasmuch as the water would displace and the sheet portion in the area of displacement would collapse. In the conventional air frame surrounded water bed mattress, the air frame was too rigid and thereby prevented an effective resting while sitting positional.

In addition to the above, the water bed mattresses of the present invention provide a substantially increased fit with respect to a surrounding support frame. Moreover, the water bed mattresses of the present invention provide a substantially increased safety factor when compared to any other conventional form of water bed mattress. In this case, it can be observed that the air chamber 38 substantially completely surrounds the entire peripheral end wall of the water chamber. Moreover, the air chamber 38 surrounds a substantial quantity of the lower portion of the water chamber 36, such that if any portion of the sheet material forming the water chamber were perforated or otherwise punctured, the air chamber 38 surrounding this water chamber 36 would prevent discharge of any of the water which might otherwise be expelled from the water chamber.

The method of producing the water bed mattresses A and B in accordance with the present invention has been described essentially in connection with the description of the water bed mattresses per se. However, in order to more fully describe the method of making these water bed mattresses A and B, reference will now be made to FIGS. 8–15 of the drawings.

FIGS. 8–12 more fully illustrate the various method steps in constructing the water bed mattress A, the latter of which is more fully illustrated in FIGS. 1–5 of the drawings, as well as the modified embodiment thereof more fully illustrated in FIG. 6 of the drawings. In accordance with producing the water bed mattress A of the present invention, a first sheet 60 is provided and has a size at least approximately equal to the total length of the upper and the lower sheets forming part of the water bed, along with twice the vertical dimension of the peripheral side wall. The sheet 60 is then at least partially unrolled and laid on a flat surface with the unrolled portion having a length equal to the length of the lower sheet in the mattress.

Thereafter, an upper sheet 62 is disposed over the lower sheet 60 in the manner as illustrated in FIG. 8 of the drawings. The intermediate sheet 62 is then heat-sealed to the lower sheet 60, in the manner as illustrated in FIGS. 9 and 10 of the drawings, and along a heat-seal line designated by reference numeral 64 in FIG. 10 of the drawings. This heat seal 64 is preferably a lap seal where the sheet 62 is secured to the lower sheet 60.

It can also be observed that the heat seal 64 has a somewhat quadrilateral, and preferably rectangular, shape including parallel and opposed longitudinal margins 66 and parallel and opposed transverse margins 68. These parallel longitudinal margins 66 and the transverse margins 68 are each connected to each other by elongated outwardly and angularly located end margins or so-called "dog-legs" 70, in the manner as illustrated in FIG. 10. These dog-legs 70 merge into the relatively straight margins 66 and 68 through arcuate corners 72. These outwardly projected elements 70 are provided so that the flange portion 74, that is the portion extending outwardly beyond the heat seal 64, has a similar dimension around its entire peripheral length. Moreover, it can be observed that the distance between the outer peripheral margin of the lower sheet 60 and the heat seal 64 is substantially identical along any portion between the heat seal 64 and the outer peripheral margin of the sheet 60 at any point along the heat seal 64.

After the intermediate sheet 62 has been heat-sealed to the lower sheet 60 along the heat seal 64, the rolled portion of the sheet 60 is unrolled in order to form an upper sheet 76, along with an end wall 78, in the manner as illustrated in FIG. 11 of the drawings. Thereafter, the flanges 74 are bent so that they are located in close proximity to the peripheral end margins of the upper sheet 76, in the manner as illustrated in FIG. 12 of the drawings. These flanges 74 are then bent over to form terminal flange portions 80 and which are heat-sealed to reversely bent flap portions 82 integral with the upper sheet 76 by means of lap seals 84. In this respect, it should be observed that the terminal flange portions 82 are lap-sealed along their entire peripheral margin to the downwardly struck flap 82 through the heat seal 84. Finally, the lower sheet 60 is provided with an upwardly struck flap portion 86 which is heat-sealed to the downwardly struck flap portion 82 by means of a heat seal 88 in order to form an interior water chamber 90 and an air chamber 92, in the manner as illustrated in FIG. 12 of the drawings.

By comparing the structure created in accordance with the method of FIGS. 8 through 12, it can be seen that this water bed mattress created therein is substantially identical to the water bed mattress described in accordance with FIGS. 1–5 of the drawings. Thus, in this case, it can be observed that the upper sheet 76 is comparable to the upper wall 10, the lower sheet 60 is comparable to the lower wall 12, and the intermediate sheet 62, along with its flange portions 74, is comparable to the intermediate wall 22.

FIGS. 13–15 more fully illustrate the method of making the water bed mattress which is actually illustrated in FIG. 7 of the drawings. In this case, it can be observed that the mattress is constructed of a lower sheet 94, an intermediate sheet 96, and an upper sheet 98, and all of which are formed of a flexible plastic material. In this case, and by reference to FIG. 14, it can be observed that the intermediate sheet 96 is lap sealed to the lower sheet 94 along a continuous seal line 100 which is substantially identical to the seal 64. In this way, it can be observed that the seal 100 would be provided with longitudinal and transverse seal margins 66 and 68, respectively, and connected by the so-called "dog-legs" or outwardly projecting ends 70. The upper sheet 98 which is provided with outer peripheral end flaps 102 and the lower sheet 94 which is provided with outer peripheral end flaps 104 integrally engage therebetween outer peripheral end flanges 106 which are integral with the intermediate sheet 96. The terminal edges 102 and 104 of the flaps, and the terminal edge of the flange 106 are thereupon butt-sealed in the manner as illustrated in FIG. 15 of the drawings.

In this way, it can also be observed that a water chamber 108 is formed in such manner that the water chamber is bounded by the upper sheet 98 along with the flange portions 106 on the intermediate sheet 96. Moreover, an air chamber 110 is bounded by a portion of the lower wall 94 and the flanges 104 in combination with the flanges on the intermediate sheet 96. In this way, it can be observed that the water bed mattress created in accordance with the method of FIGS. 13–15 is similar to the water bed mattress created in accordance with the method of FIGS. 8–12 except that it adopts the configuration and construction as illustrated in FIG. 7 of the drawings.

FIG. 16 illustrates a modified form of water bed mattress constructed in accordance with and embodying the present invention and differs only from the water bed mattress previously described in that an arcuately shaped section **26*b* corresponding to the arcuately shaped section 26 connects the downwardly struck flange 28 and the intermediate wall 24 and is somewhat shorter than the total length of the wall 24 and flange 26. Moreover, the flange designated as 28*b* is heat-sealed to the struck flap 14 by means of a heat seal 30*b*. In this way, the arcuately shaped portion 26*b* is located somewhat beneath the upper sheet 10 by a few inches, but which nevertheless provides a water chamber for supporting a body but nevertheless supports the water chamber along its periphery by an air chamber. Otherwise, the construction of the water bed mattress, as illustrated in FIG. 16 is substantially identical to the construction of the water bed mattress illustrated in FIGS. 1–5 of the drawings. The water bed mattress as illustrated in FIG. 16 of the drawings does not otherwise differ from the water bed mattress illustrated in FIGS. 1–5 of the drawing except that the arcuately shaped section 26*b* is spaced below the sheet 10 and is secured to the lower flap 16**, which most often is desirable in many constructions of the water bed mattress.

In addition, it can be observed that the flange **26*b* could also be sealed to the upwardly struck flap 16 or otherwise butt sealed as previously described. Nevertheless, an air chamber 38 extends peripherally around the entire outer wall of the water bed mattress A and, in this way, the air still chamber increases in size with the increased depth in the outer peripheral wall 22**.

Referring now to FIG. 17 of the drawings which illustrate a more preferred embodiment of the present invention, a water bed mattress 112 is illustrated in a ridgid frame 114 supported on a base 116. This mattress comprising an upper flexible plastic sheet 118 and a lower flexible plastic sheet 120, and both of which are substantially rectangular in their construction, but with rounded corner margins.

The upper and lower sheets 118 and 120 are both substantially of the same overall size and are marginally registered with each other, and the upper sheet includes an integrally formed downwardly struck peripherally extending end flap 122. In like manner, the lower wall 120 includes an integrally formed upwardly struck peripherally extending flap 124 which is lap-sealed to the end flap 122 at a seal 126 thereby forming a peripheral outer end wall 128. In this case, it can be observed that the flap 122 which is integral with the upper wall 118 is located exteriorly of the flap 124 in order to form the lap-seal 124. However, it should also be understood that the flap 124 could be located exteriorly of the flap 122 in order to form the lap-seal 126, or otherwise a butt seal could be used.

The preferred embodiment of the water bed mattress of the present invention also includes a flexible plastic intermediate sheet 128 which has an interior intermediate section 130 disposed on the interiorly presented surface of the lower sheet 120 and which is integrally provided with a somewhat tapered peripherally extending inner side wall 132 which is more fully illustrated in FIG. 17 of the drawing. This inner peripheral wall 132 includes a diagonally inwardly and downwardly extending wall section 134 merging into the intermediate sheet 128 and which wall section 134 is formed at its upper end with an arcuately shaped section 136. This arcuately shaped section 136, in turn, integrally merges into a downwardly extending flange 138 which is essentially located in juxtaposition to the downwardly struck flap 124. The downwardly struck flange 138 is also lap-sealed to the interior surface of the flap 124 by means of a lap-sealed 140.

The peripheral margin 142 of the intermediate sheet 128, that is the location where the sheet 128 merges into the side wall 132, is lap-sealed to the lower sheet 120 by means of a lap-seal 144.

By further reference to FIG. 17 of the drawings, it can be observed that the arcuately shaped section 136 of the inner peripheral wall 132 is located somewhat spaced below the peripheral margin of the upper wall 120. Nevertheless, the curved section 136 is located in approximate vertical registration with the corner margin extending between the upper wall 118 and the downwardly struck flap 122. However, it should be observed that in this embodiment of the invention, the size of the intermediate sheet bounded by the lap-seal 144 is relatively small compared to the inner wall 132. The intermediate sheet need be only large enough to accommodate the size of a conventional heating pad. Thus, the length of the lap seal 144 relative to the longitudinal dimension of the mattress could be ⅛ to ⅞ and the ratio regarding the transverse dimension or width of the mattress would be the same.

In accordance with the above-outlined construction, it can be observed that the upper sheet 118 and the inner peripheral wall 132, along with the intermediate sheet 128 on the lower sheet 120, defines a water chamber 146. Moreover, it can be observed that the other side of the inner peripheral wall 132, along with the bottom wall 120 and the side wall 128, forms an outer air chamber 148. In this construction it can still be observed that the water chamber is substantially contiguous with the entire upper surface of the upper wall 118 in such manner that the entire upper surface of the water bed mattress is defined only by the water chamber. Nevertheless, it can also be observed that the air chamber 148 extends peripherally around the entire outer wall of the water bed mattress.

In each of the previously described embodiments of the water bed mattress of the present invention, any of a number of plastic materials may be used, and include for example, various forms of vinyl sheets, polyethylene, polystyrene, and polybutadiene copolymers and the like.

While the materials mentioned above are thermoplastics in nature, it should be understood that many thermosetting resins could also be used. In addition, various flexible non-plastic materials could also be employed, as for example, various textile materials which are water impervious and which may be plastic impregnated, such as those cloth materials which are impregnated with a vinyl plastic material to render the same water impervious. The upper and lower sheets as well as the outer and inner peripheral side walls should preferably have a thickness of no less than 20 mils. However, the desired thickness may be predicated upon the overall size of the mattress itself.

In addition to the foregoing advantages of the water bed mattresses of the present invention, these mattresses are highly unique in that they enable the user thereof to regulate the air pressure in the air bladder relative to the amount of water in the air bladder, and thereby provide adjustable support. In this way an individual may rest or sleep across the entire top surface of the mattresses which are supported on their periphery by an air bladder. In addition to the adjustable firmness, no bottoming-out can occur. Moreover, since the water bladder is smaller than water chambers in conventional water bed mattresses, the mattresses of the present invention can be filled quicker and drained quicker. Furthermore, due to less water content, less energy is required to heat the water to a desired water bed temperature. Thus, longer life is afforded to the water bed mattresses of the present invention since lesser pressure is exerted upon the various seams in the mattresses.

Thus there has been illustrated and described various forms of novel water bed mattress constructions, as well as methods of making the same, and which water bed mattresses can be made at a relatively low cost and used in a wide variety of applications. Consequently, the water bed mattresses described herein and the methods of making the same fulfill all the objects and advantages sought therefor. Many changes, modifications, variations and other uses and applications of water bed mattresses and the method of making the same will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. A water bed mattress comprising a. an upper sheet having a peripheral end margin, b. a lower sheet having a peripheral end margin and being in spaced apart relationship to said upper sheet, c. a peripheral inner wall extending between and secured in operative relationship to said upper and lower sheets and forming a water chamber between said inner wall and upper and lower sheets, d. said inner wall being inclined so that it extends in proximate relationship to the peripheral end margin of said upper sheet to form said water chamber substantially continuous with the surface of said upper sheet so that substantially the entire upper sheet is supported by water in said water chamber, and said inner wall extending inwardly from the peripheral end margin of said lower sheet and being secured to said lower sheet inwardly of its peripheral end margin, e. and a peripheral outer wall extending between said upper and lower sheets forming an air chamber bounded by said outer and said inner wall and said lower sheet so that said air chamber when filled with air provides continuous peripheral support by the air which is relatively less yieldable than the water in said water chamber, said water chamber having a periphery substantially contiguous with the periphery of said air chamber such that the air chamber can provide continuous peripheral support.

2. The water bed mattress of claim 1 further characterized in that said peripheral outer wall having sections integral with said upper and lower sheets.

3. The water bed mattress of claim 1 further characterized in that said upper and lower sheets have angularly struck flaps which are respectively integral with said upper and lower sheets and which flaps are sealed to each other to form said outer peripheral wall.

4. The water bed mattress of claim 1 further characterized in that said upper and lower sheets have angularly struck flaps which are respectively integral with said upper and lower sheets and which flaps are lap sealed to each other to form said outer peripheral wall, and said inner wall having a terminal peripherally extending flange which is lap sealed to one of the flaps integral with said upper and lower sheets.

5. The water bed mattress of claim 4 further characterized in that said flange is lap sealed to the flap integral with said lower sheet.

6. The water bed mattress of claim 4 further characterized in that said flange is lap sealed to the flap integral with said lower sheet.

7. The water bed mattress of claim 1 further characterized in that said upper and lower sheets have respective downwardly and upwardly struck flaps which are integral with said respective upper and lower sheets, said flaps having terminal flanges extending peripherally around the water bed mattress, and said inner peripheral wall having a flange extending peripherally therearound, and each of said flanges being butt-sealed to one another.

8. The water bed mattress of claim 1 further characterized in that said upper and lower sheets and said inner and outer peripheral walls are formed of a flexible plastic material.

9. The water bed mattress of claim 1 further characterized in that said water bed mattess is provided with a closeable air inlet communicating with said air chamber and a closeable water inlet communicating with said water chamber.

10. The water bed mattress of claim 4 further characterized in that said inner wall is provided with a second terminal peripherally extending flange which is lap-sealed to said lower sheet.

11. A water bed mattress comprised of upper and lower spaced apart walls, an outer peripheral wall extending between said upper and lower walls, an inclined inner peripheral wall extending between said upper and lower walls to form a water chamber between and substantially bounded by said upper wall and lower wall and inner peripheral wall, said inner peripheral wall having an upper portion which extends in proximate relationship to the peripheral end margin of said upper wall to form said water chamber substantially continuous with said upper wall so that substantially the entire upper wall is supported by water in said water chamber, said inner peripheral wall extending inwardly with respect to the peripheral end margin of said lower wall and being secured thereto to form an air chamber between and substantially bounded by said lower wall and said outer wall and said inner wall, said air chamber when filled with air providing continuous peripheral support by the air which is relatively less yieldable than the water in said water chamber, said water chamber having a periphery substantially contiguous with the periphery of said air chamber such that the air chamber can provide continuous peripheral support.

12. The water bed mattress of claim 11 further characterized in that said outer and inner peripheral walls having portions which are butt-sealed to each other.

13. The water bed mattress of claim 11 further characterized in that said outer and inner peripheral walls having portions which are lap-sealed to each other.

14. The water bed mattress of claim 11 further characterized in that the outer peripheral wall is comprised of flaps integral with said upper and lower walls and which flaps are sealed to each other.

15. A water bed type mattress comprising a. an upper sheet having a peripheral end margin, b. a lower sheet having a peripheral end margin and being in spaced apart relationship to said upper sheet, c. a first peripheral inner wall extending between and secured in operative relationship to said upper and lower sheets and forming a liquid chamber between said inner wall and upper and lower sheets, d. said inner wall being inclined so that it extends in proximate relationship to the peripheral end margin of said upper sheet to form said liquid chamber substantially continuous with the surface of said upper sheet so that substantially the entire upper sheet is supported by liquid in said liquid chamber, and said inner wall extending inwardly from the peripheral end margin of said lower sheet and being secured to said lower sheet inwardly of its peripheral end margin, e. and a second peripheral outer wall extending between said upper and lower sheets forming an air chamber bounded by said outer and said inner wall and said lower sheet so that said air chamber when filled with air provides continuous peripheral support by the air which is relatively less yieldable than the liquid in said liquid chamber, said liquid chamber having a periphery substantially contiguous with the periphery of said air chamber such that the air chamber can provide continuous peripheral support.

16. A water bed mattress comprising a. an upper sheet formed of a flexible plastic material and having a peripheral end margin, b. a lower sheet formed of a flexible plastic material and having a peripheral end margin and being in spaced apart relationship to said upper sheet, c. a peripheral inner wall formed of a flexible plastic material, said inner wall extending between and secured in operative relationship to said upper and lower sheets and forming a water chamber between said inner wall and upper and lower sheets, d. said inner wall having an inclined portion extending from said upper sheet inwardly and to said lower sheet, said inner wall having a curved upper portion extending from said inclined portion so that the curved upper portion extends in proximate relationship to the peripheral end margin of said upper sheet to form said water chamber substantially continuous with the surface of said upper sheet so that substantially the entire upper sheet is supported by water in said water chamber, said inclined wall having an attachment strip extending from the curved upper portion and being secured to said mattress at points other than upper sheet, said inner wall extending inwardly from the peripheral end margin of said lower sheet and having a lower portion secured to said lower sheet inwardly of its peripheral end margin, e. a peripheral outer wall formed of a flexible plastic material, said outer wall extending between said upper and lower sheets forming an air chamber bounded by said outer and said inner wall and said lower sheet so that said air chamber when filled with air provides continuous peripheral support by the air which is relatively less yieldable than the water in said water chamber, said water chamber having a periphery substantially contiguous with the periphery of said air chamber such that the air chamber can provide continuous peripheral support, f. a closeable air inlet communicating with said air chamber, g. and a closeable water inlet communicating with said water chamber.

17. The water bed mattress of claim 16 further characterized in that said upper and lower sheets have angularly struck flaps which are respectively integral with said upper and lower sheets and which flaps are sealed to each other to form said outer peripheral wall.

18. The water bed mattress of claim 16 further characterized in that said upper and lower sheets have angularly struck flaps which are respectively integral with said upper and lower sheets and which flaps are lap sealed to each other to form said outer peripheral wall, and said inner wall having a terminal peripherally extending flange which is lap sealed to one of said flaps integral with said upper or lower sheets.

19. The water bed mattress of claim 18 further characterized in that said flange is lap sealed to the flap integral with said lower sheet.

20. The water bed mattress of claim 18 further characterized in that said flange is lap sealed to the flap integral with said lower sheet.

* * * * *